US009638385B2

(12) United States Patent
Shin et al.

(10) Patent No.: US 9,638,385 B2
(45) Date of Patent: May 2, 2017

(54) HEAD LAMP IN VEHICLE

(71) Applicants: Hyundai Motor Company, Seoul (KR); Hyundai Mobis Co., Ltd., Seoul (KR)

(72) Inventors: Jik Soo Shin, Incheon (KR); Soohan Im, Seoul (KR)

(73) Assignees: Hyundai Motor Company, Seoul (KR); Hyundai Mobis Co., Ltd., Seoul (KR)

( * ) Notice: Subject to any disclaimer, the term of this patent is extended or adjusted under 35 U.S.C. 154(b) by 184 days.

(21) Appl. No.: 14/521,994

(22) Filed: Oct. 23, 2014

(65) Prior Publication Data

US 2015/0184822 A1 Jul. 2, 2015

(30) Foreign Application Priority Data

Dec. 26, 2013 (KR) ..... 10-2013-0164098

(51) Int. Cl.
*F21S 8/12* (2006.01)
*F21S 8/10* (2006.01)

(52) U.S. Cl.
CPC ..... *F21S 48/1784* (2013.01); *F21S 48/125* (2013.01); *F21S 48/13* (2013.01); *F21S 48/142* (2013.01); *F21S 48/145* (2013.01)

(58) Field of Classification Search
CPC .. F21S 48/125; F21S 48/1258; F21S 48/1305; F21S 48/14; F21S 48/142; F21S 48/145; B60Q 1/1438
See application file for complete search history.

(56) References Cited

U.S. PATENT DOCUMENTS

2002/0051365 A1* 5/2002 Yokoi ..... F21S 48/145 362/512
2011/0170308 A1* 7/2011 Kinoshita ..... B60Q 1/076 362/516
2013/0107560 A1 5/2013 Kim et al.

FOREIGN PATENT DOCUMENTS

JP 2008-027650 A 2/2008
JP 2008-192313 A 8/2008
KR 10-2004-0037949 A 5/2004
KR 10-0506712 B1 8/2005
KR 10-2010-0025253 A 3/2010
KR 10-2011-0074345 A 6/2011
(Continued)

*Primary Examiner* — Bao Q Truong
*Assistant Examiner* — Nathaniel Lee
(74) *Attorney, Agent, or Firm* — Morgan, Lewis & Bockius LLP

(57) ABSTRACT

A head lamp in a vehicle may include a light source for emitting a light, a reflector for reflecting the light forward from the light source, a lens for transmitting the light being forwarded toward a front from the light source and the reflector, a holder having one end coupled to the lens and the other end coupled to the reflector to make the lens spaced at a predetermined distance from the reflector, and a movable shield disposed between the light source and the reflector and the lens for selectively shielding a portion of the light being forwarded toward the lens from the light source and the reflector, or not shielding the portion of the light being forwarded toward the lens from the light source and the reflector when being moved to create a space between the movable shield and a lower end of the holder to allow the light pass through.

11 Claims, 7 Drawing Sheets

(56) References Cited

FOREIGN PATENT DOCUMENTS

| | | | |
|---|---|---|---|
| KR | 10-2012-0011213 | A | 2/2012 |
| KR | 10-2012-0050270 | A | 5/2012 |

* cited by examiner

HEAD LAMP IN VEHICLE

CROSS-REFERENCE TO RELATED APPLICATION

The present application claims priority of Korean Patent Application Number 10-2013-0164098 filed on Dec. 26, 2013, the entire contents of which application are incorporated herein for all purposes by this reference.

BACKGROUND OF INVENTION

Field of Invention

The present invention relates to a head lamp in a vehicle. More particularly, the present invention relates to a head lamp in a vehicle of which luminance efficiency is increased.

Description of Related Art

In general, the head lamp in the vehicle is also called as a head light or a head lamp which is a lamp to light a front direction for safe running of the vehicle at night or in a dark space. Though it was mostly circular before, currently a lamp having a unique shape and structure is increasingly matched with a design of a vehicle body.

The head lamp in a vehicle is made to have a light beam therefrom to be shifted in up/down directions for preventing a driver of an opposite vehicle from being dazzled by the light beam emitted from the head lamp. According to a safety standard, it is a regulation that a high beam is required to identify an obstacle existing at 100 m ahead of the vehicle and a low beam is required to identify an obstacle existing at 40 m ahead of the vehicle.

In order to implement such a high beam and a low beam, there is a shield interposed between a light source and a lens. The shield is made to shield a portion of the light incident on the lens from the light source or a reflector. And, according to a shape and movement of the shield, the high beam or the low beam is implemented, selectively.

However, since the light shielded by the shield is failed to be used as an effective light of the head lamp, there may be a limit of head lamp efficiency. And, if the luminance efficiency of the light passing through the shield is too low, the head lamp efficiency may become poor in comparison to a performance of the light source.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a head lamp in a vehicle having improved luminance efficiency. Accordingly, the present invention, created for solving above and/or other problems, is to provide a head lamp in a vehicle which can improve luminance efficiency. And, the present invention is to provide a head lamp in a vehicle which can improve a performance of high beam with a simple configuration.

According to various aspects of the present invention, a head lamp in a vehicle may include a light source for emitting a light, a reflector for reflecting the light forward from the light source, a lens for transmitting the light being forwarded toward a front from the light source and the reflector, a holder having one end coupled to the lens and the other end coupled to the reflector to make the lens spaced alt a predetermined distance from the reflector, and a movable shield disposed between the light source and the reflector and the lens for selectively shielding a portion of the light being forwarded toward the lens from the light source and the reflector, or not shielding the portion of the light being forwarded toward the lens from the light source and the reflector when being moved to create a space between the movable shield and a lower end of the holder to allow the light pass through.

The movable shield may shield the portion of the light being forwarded toward the lens with one side, and the light emitted to the space formed between the movable shield and the lower end of the holder from the light source when the movable shield is moved may be reflected at the other side of the movable shield and directed to the front.

The light reflected at the other side of the movable shield and directed to the front may produce a high beam.

The movable shield may be hinge coupled to the holder and movable by a hinge motion. The head lamp may further include a solenoid connected to the movable shield for moving the movable shield upon having power supplied thereto.

The head lamp may further include a fixed shield provided between the movable shield and the lens and having one side for shielding the portion of the light being forwarded toward the lens from the light source and the reflector and the other side for absorbing lights reflected and scattered by an inside surface of the holder and by an inside surface of the lens.

The movable shield may be hinge coupled to the fixed shield and movable by a hinge motion. The head lamp may further include a solenoid coupled to the fixed shield connected to the movable shield for moving the movable shield upon having power supplied thereto.

The head lamp may further include an elastic member provided to a portion at which the movable shield and the fixed shield are hinge coupled for returning the movable shield to an original position if power supply to the solenoid is cut off.

The reflector may have a stopper formed thereon for being brought into contact with the moving movable shield for preventing the hinge motion of the movable shield from progressing excessively by the solenoid. The stopper may be formed to prevent impact of contact with the movable shield.

The head lamp may further include a buffer portion formed at a portion the fixed shield is to be brought into contact with the movable shield for preventing an impact of contact with the fixed shield when the movable shield returns to the original position by the hinge motion owing to the elastic member.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
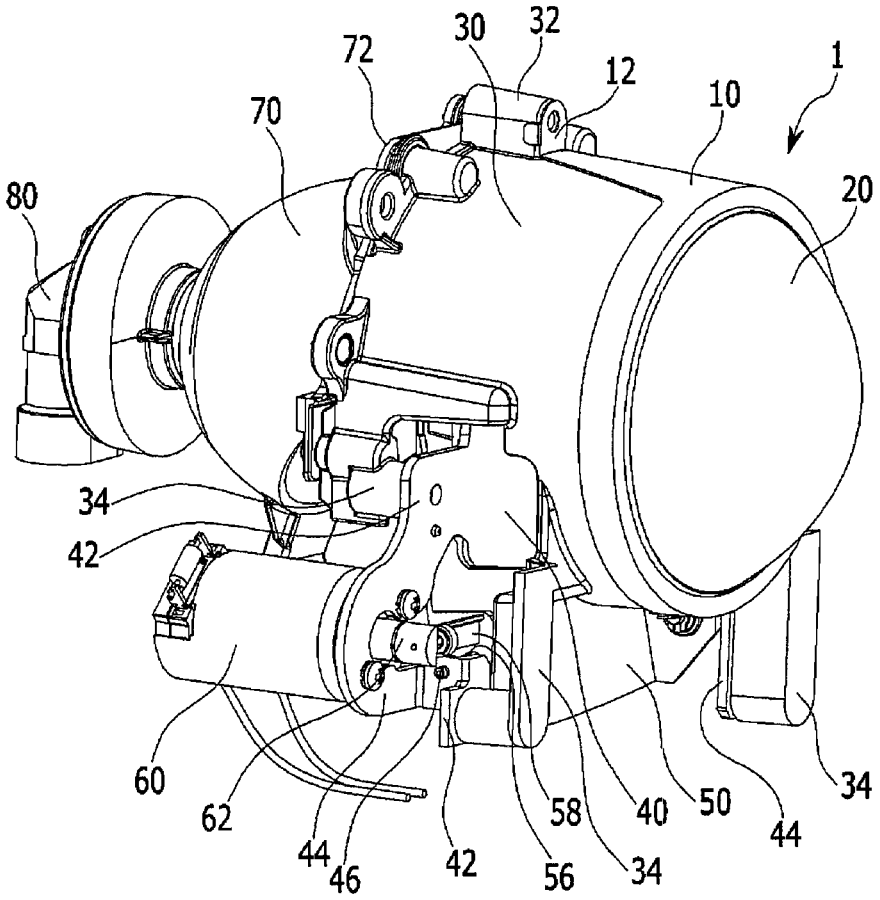
FIG. 1 illustrates a perspective view of an exemplary head lamp in a vehicle in accordance with the present invention.
Figure 2:
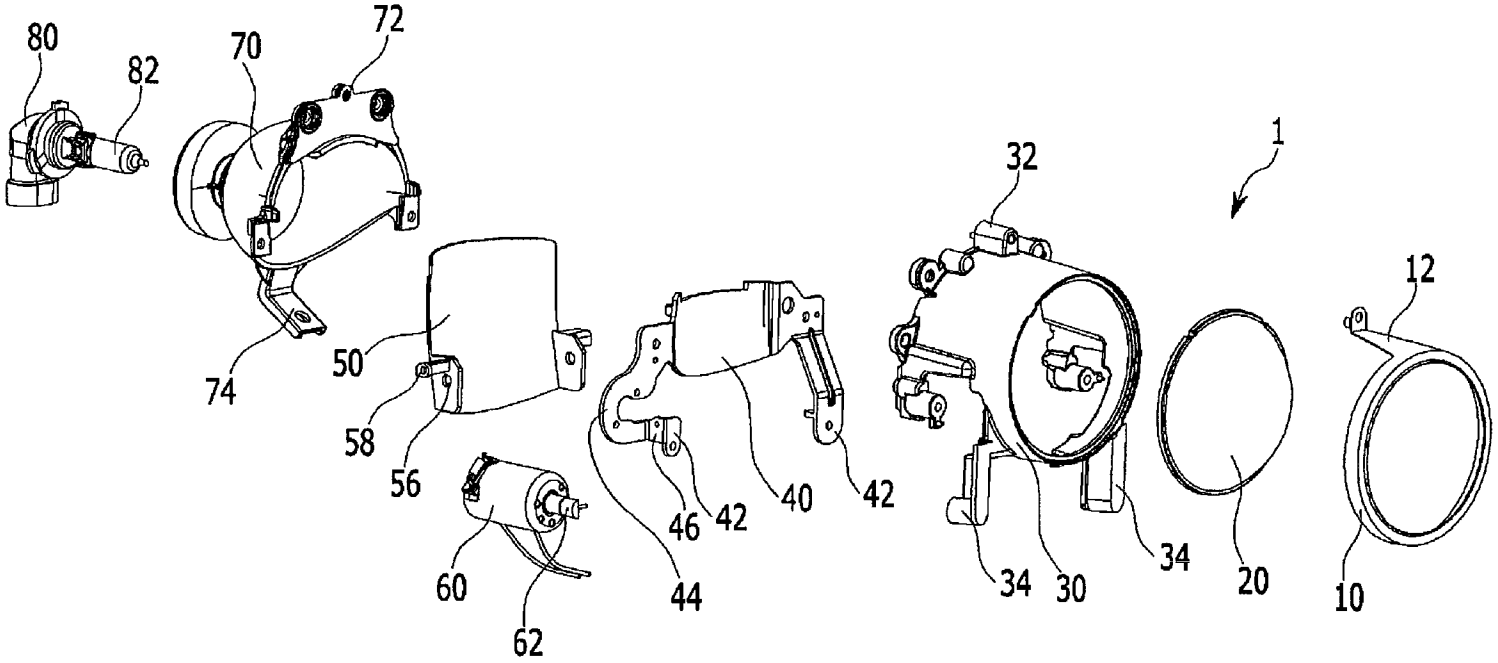
FIG. 2 illustrates an exploded perspective view of an exemplary head lamp in a vehicle in accordance with the present invention.

FIG. 1 illustrates a perspective view of a head lamp in a vehicle in accordance with various embodiments of the present invention, and FIG. 2 illustrates an exploded perspective view of a head lamp in a vehicle in accordance with various embodiments of the present invention. Referring to FIGS. 1 and 2, the head lamp in a vehicle 1 in accordance with various embodiments of the present invention includes a light source 80, a reflector 70, a lens 20, a lens seating ring 10, a holder 30, a fixed shield 40, a movable shield 50, and a solenoid 60.

The light source 80 functions to receive electric energy and convert the electric energy received thus to light energy. And, the light source 80 includes a light emitting portion 82. The light emitting portion 82 is a portion the light energy converted thus, i.e., a light, is emitting therefrom. Moreover, the light emitting portion 82 is arranged in the head lamp 1.

The reflector 70 is coupled to the light source 80, and the light emitting portion 82 of the light source 80 is placed in, and arranged on an inner side of, the reflector 70. And, the reflector 70 is provided to reflect at least a portion of the light emitted from the light emitting portion 82 of the light source 80 toward a front of the head lamp 1. Moreover, the reflector 70 is formed in a half cut eclipse shape or substantially in a half cut eclipse shape. The shape of the reflector 70 may be the same as or similar to those in the art, and thus more detailed description of the shape of the reflector 70 will be omitted.

The lens 20 is provided to focus the light emitted from the light emitting portion 82 and direct the light to the front of the head lamp 1. And, an overall shape of the lens 20 is formed in a circular shape that is an overall shape of a general lens. Moreover, in order to achieve a required aberration correction state with a small number of faces, the lens 20 may be an aspherical lens.

The lens seating ring 10 is formed in an annular shape to surround the circular lens 20. And, the lens 20 is seated on an inside circumference of the lens seating ring 10.

The holder 30 has a cylindrical shape or substantially a cylindrical shape in overall with opened both sides for coupling to the main lens 20 and the lens seating ring 10. And, in a state a circular circumference of the lens 20 is in contact with a circumference of the opened one side of the holder 30, as the annular lens seating ring 10 is coupled to the holder 30 while surrounding the lens 20, the holder 30 and the lens 20 are coupled, together.

The fixed shield 40 is interposed between the light emitting portion 82 and the lens 20. And, the fixed shield 40 is formed to have a plate shape for shielding a portion of the light forwarded toward the lens 20 from the light emitting portion 82 of the light source 80 and the reflector 70. In the meantime, the plate shape of the fixed shield 40 has one side for shielding a portion of the light forwarded toward the lens 20, and the other side for absorbing the lights reflected and scattered at an inside surface of the holder 30 and an inside surface of the lens 20. In this case, the fixed shield 40 is arranged such that the one side of the fixed shield 40 faces a rear of the head lamp 1, and the other side of the fixed shield 40 faces the front of the head lamp 1.

The fixed shield 40 is coupled to the other opened side of the holder 30. And, the other opened side of the holder 30 is coupled to the reflector 70, and the fixed shield 40 is interposed between the other side of the holder 30 and one end of the reflector 70. That is, the holder 30 is arranged to space the lens 20 and the fixed shield 40 as much as a width of the holder 30.

The movable shield 50 is interposed between the reflector 70 and the fixed shield 40. And, the movable shield 50 is coupled to, such as hinge coupled to, a lower end of the fixed shield 40. Moreover, the movable shield 50 is formed to have a plat shape. In the meantime, the plate shape of the movable shield 50 has one side formed for shielding the light, and the other side formed for reflecting the light. In the meantime, the hinge coupling of the movable shield 50 is not limited to the lower end of the fixed shield 40, but the hinge coupling of the movable shield 50 may be to the holder 30.

The solenoid 60 is coupled to the fixed shield 40, and provided for making the movable shield 50 hinge coupled to the fixed shield 40 to make a hinge motion. In this case, the solenoid 60 may be an ON/OFF solenoid 60 which is operated in two stages of ON or OFF depending on supply or cut off of power thereto.

The lens seating ring 10 has an extended coupling portion 12 formed thereon extended toward the holder 30 from the annular circumference of the holder 30 for coupling to the holder 30, the holder 30 has a two ended coupling portion 32 formed thereon having one end for coupling to the extended coupling portion 12 and the other end for coupling to the reflector 70, and the reflector 70 has a holder coupling portion 72 for coupling to the other end of the holder coupling portion 32. That is, by coupling of the extended coupling portion 12, the two ended coupling portion 32, and the holder coupling portion 72, the lens seating ring 10, the holder 30 and the reflector 70 are coupled together.

Formed on the fixed shield 40, there are a securing portion 42 extended from the plate shape of the fixed shield 40 for coupling to the holder 30 to secure the fixed shield 40, a solenoid coupling portion 44 extended from the plate shape of the fixed shield 40 for the solenoid 60 to couple thereto, and a movable shield coupling portion 46 extended from the plate shape of the fixed shield 40 for hinge coupling to the movable shield 50. In the meantime, the holder 20 has a fixed shield coupling portion 34 formed thereon additionally for coupling to the securing portion 42.

Formed on the movable shield 50, there are a hinge portion 56 for hinge coupling to the fixed shield 40, and a solenoid connection portion 58 for connection to the solenoid 60.

The solenoid 60 includes a movable portion 62 movable as the power is supplied or cut off thereto/therefrom, and the solenoid connection portion 58 of the movable shield 50 is connected to the movable portion 62 of the solenoid 60. And, the solenoid connection portion 58 is moved by movement of the movable portion 62, which makes the movable shield 50 to move.

Figure 3:
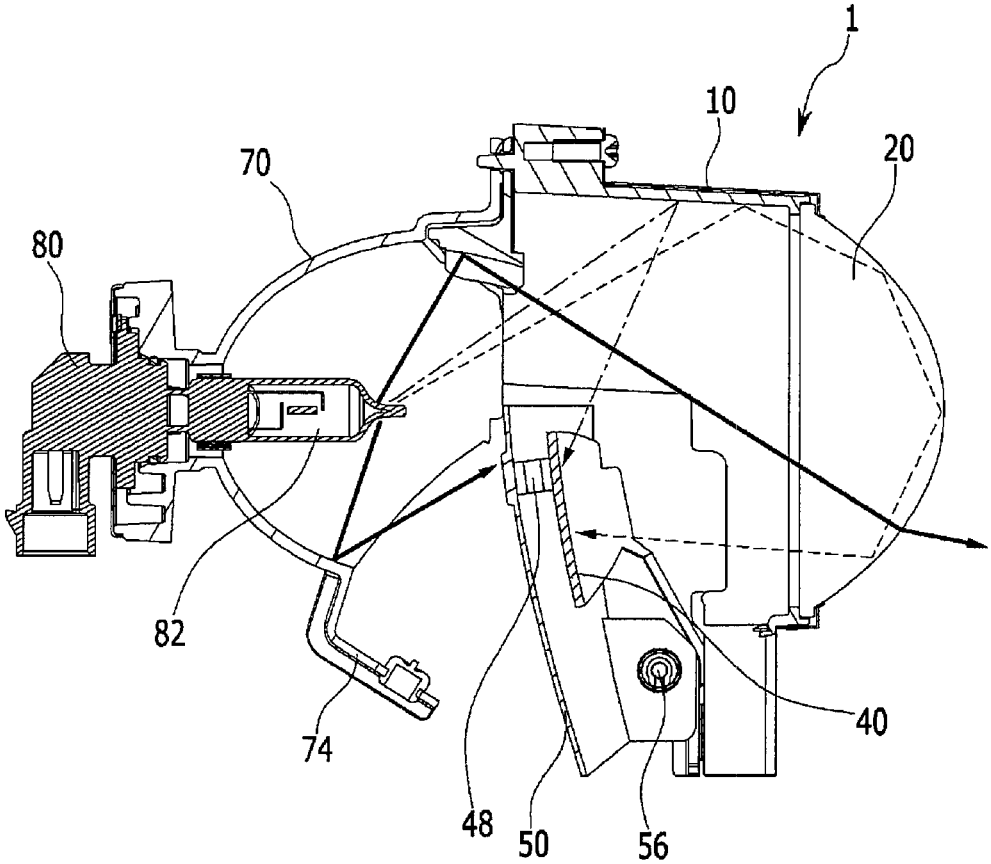
FIG. 3 illustrates a longitudinal half sectional view of an exemplary head lamp in a vehicle in accordance with the present invention, before a movable shield is moved.

FIG. 3 illustrates a longitudinal half sectional view of a head lamp in a vehicle in accordance with various embodiments of the present invention, before a movable shield is moved. Referring to FIG. 3, before movement, the movable shield 50 is arranged to shield a light proceeding toward the lens 20 reflected at the reflector 70 to form the high beam or a light proceeding toward the lens 20, directly. That is, the movable shield 50 has one side arranged to shield the light proceeding toward the lens 20 from the reflector 70 and the light emitting portion 82. In this case, a light not shielded by the movable shield 50 is directed to and transmitted through the lens 20 to form the low beam, and the other side of the fixed shield 40 arranged in front of the movable shield 50 functions to absorb reflected and scattered lights.

FIG. 3 illustrates that paths of the light shielded by the movable shield 50 and the light transmitting through the lens 20 to form the low beam are shown in solid lined arrows, and the reflected and scattered lights absorbed to the other side of the fixed shield 40 are shown in dotted arrow line(s).

Figure 4:
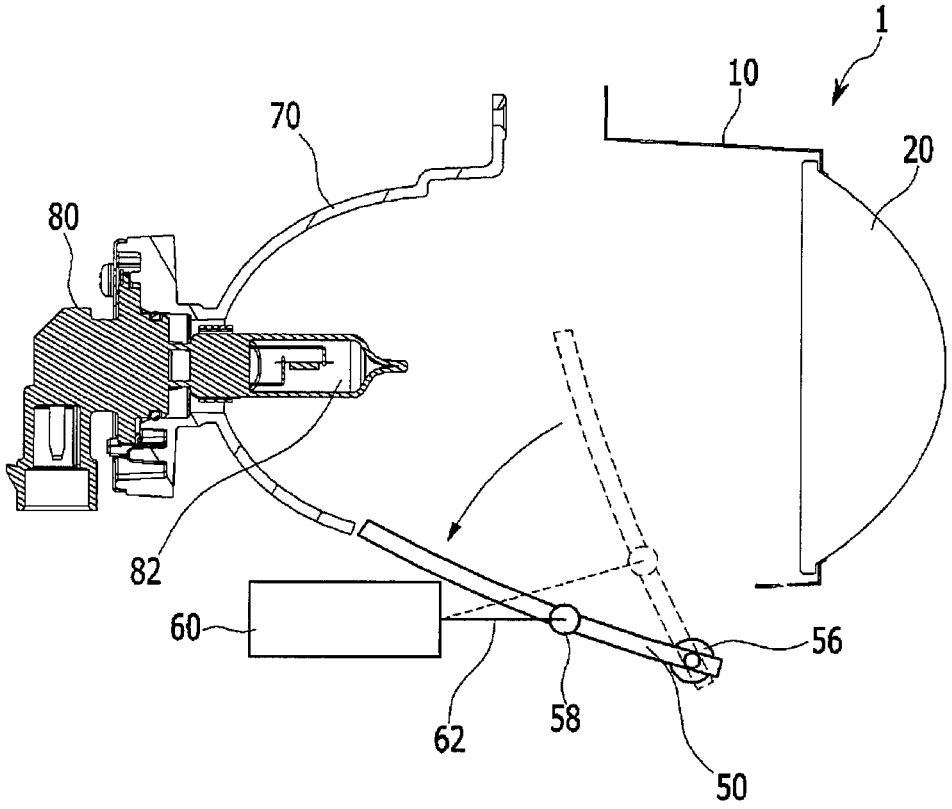
FIG. 4 illustrates a schematic view showing moving of a movable shield in an exemplary head lamp in a vehicle in accordance with the present invention.

FIG. 4 illustrates a schematic view showing moving of a movable shield in accordance with various embodiments of the present invention. Referring to FIG. 4, if the movable shield makes the hinge motion as power is supplied to the solenoid 60, and the movable portion 62 of the solenoid 60 is moved, a space is opened, through which a light can pass between a lower end of the holder 30 and the hinge portion 56. In this case, the hinge portion 56 is arranged below the lower end of the holder 30, and the movable shield 50 makes the hinge motion in a direction moving away from the lower end of the holder 30 centered on the hinge portion 56. In this case, in order to prevent the hinge motion of the movable shield from progressing excessively, the reflector 70 has a stopper 74 formed thereon to be brought into contact with the movable shield 50 being moved thus. And, the stopper 74 is formed to absorb an impact caused by the hinge motion of the movable shield 50.

Figure 5:
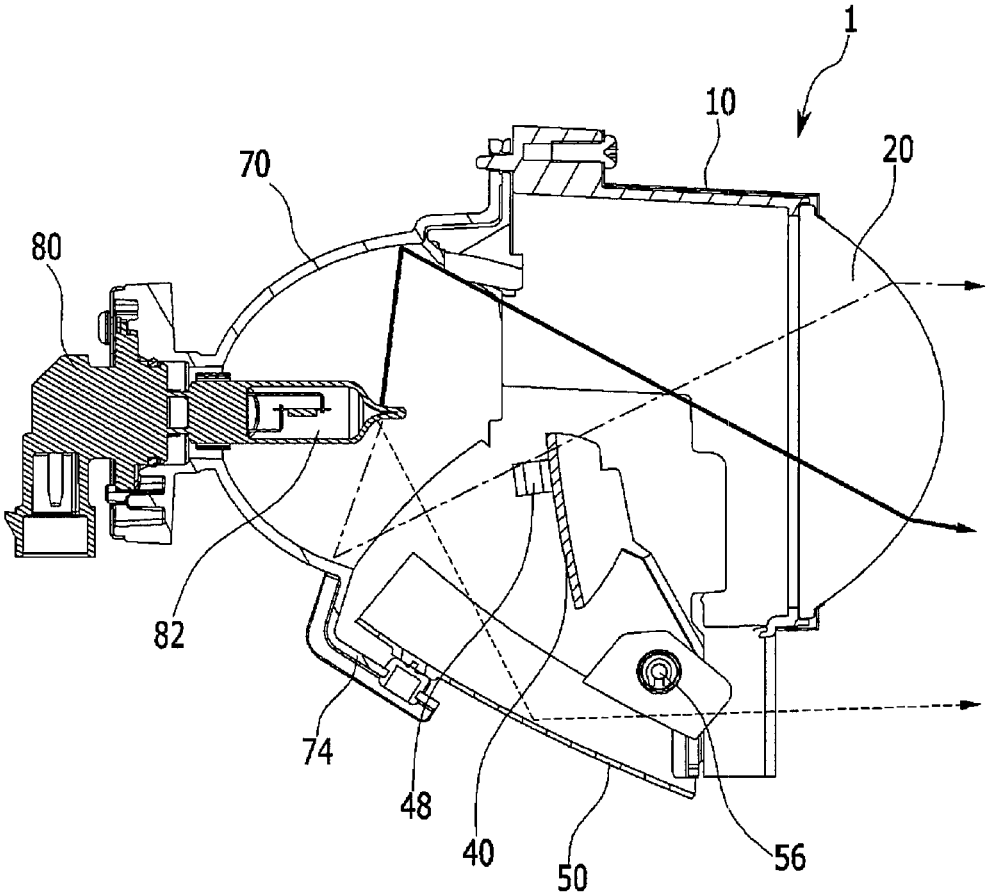
FIG. 5 illustrates a longitudinal half sectional view of an exemplary head lamp in a vehicle in accordance with the present invention, after a movable shield is moved.

FIG. 5 illustrates a longitudinal half sectional view of a head lamp in a vehicle in accordance with various embodiments of the present invention, after a movable shield is moved. Referring to FIG. 5, after the movement, the movable shield 50 is arranged to form a space through which a light can pass between the fixed shield 40 and the movable shield 50. In this case, the light emitted from the light emitting portion 82 of the light source 80 through the space formed between the fixed shield 40 and the movable shield 50 is reflected at the other side of the movable shield 50 and directed to form the high beam, and the light shielded by one side of the movable shield 50 before the movable shield 50 is moved transmits through the lens 20 and developed to form the high beam. Therefore, a high beam directing area is enlarged than a case when only the light transmitting through the lens 20 forms the high beam. In the meantime, the light which transmits through the lens 20 and is developed to form the low beam may always be developed without being shielded.

FIG. 5 shows paths of lights transmitting through the lens 20 to form the low beam and the high beam and lights reflected at the other side of the movable shield 50 to form the high beam with dotted arrow line(s).

Figure 6A:
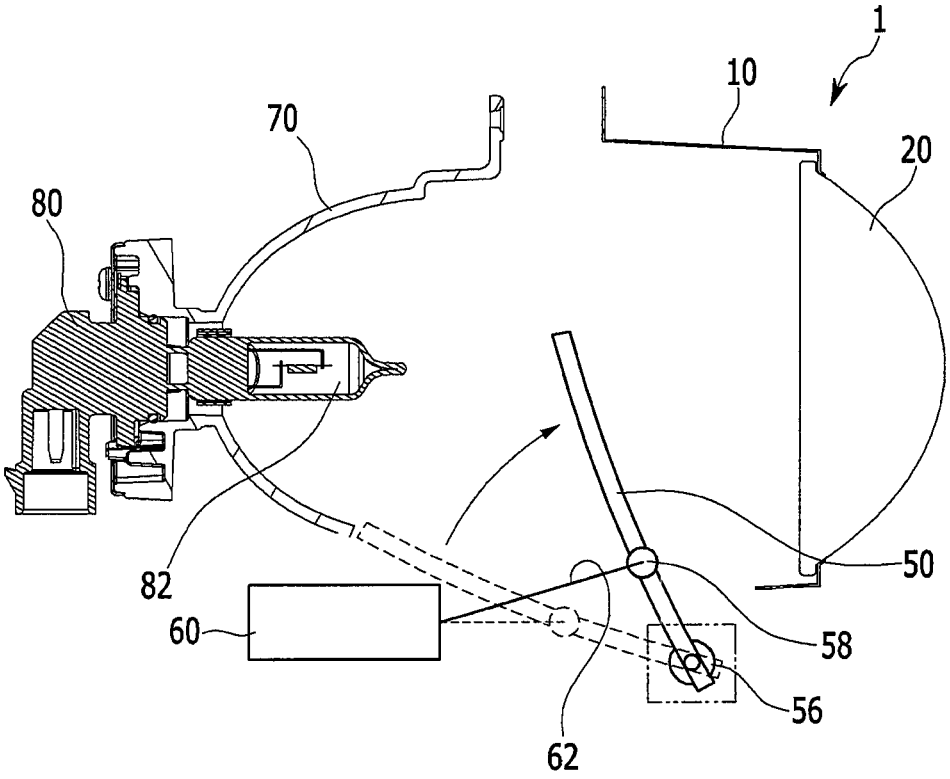
FIG. 6A illustrates a schematic view showing a movable shield in an exemplary head lamp in a vehicle in accordance with the present invention, returning to an original position.
Figure 6B:
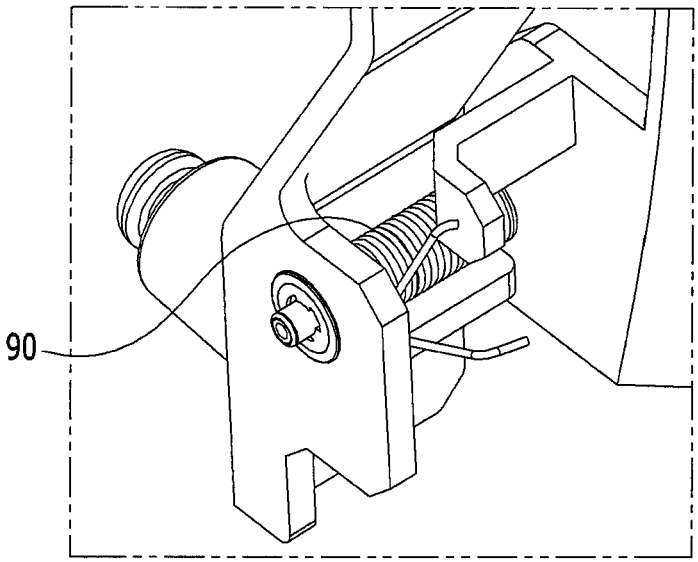
FIG. 6B is a partially enlarged view of FIG. 6A.

FIG. 6 illustrates a schematic view showing a movable shield in accordance with various embodiments of the present invention, returning to an original position. FIG. 6A is a partially enlarged view of FIG. 6. Referring to FIGS. 6 and 6A, if the movable shield 50 returns to an original position as power supply to the solenoid 60 is cut off, and movement of the movable portion 62 of the solenoid 60 is stopped, the space is closed, through which the light can pass between the lower end of the holder 30 and the hinge portion 56. In this case, the hinge portion 56 has an elastic member 90 provided thereto, and the movable shield 50 makes a hinge motion in a direction the movable shield 50 is returned to an original position by elastic force of the elastic member 90 as power supply to the solenoid 60 is cut off. In this case, the movable shield 50 may be brought into contact with the fixed shield 40 as the movable shield 50 returns to the original position, and the fixed shield 40 has a buffer portion 48 formed thereon for being brought into contact with the other side of the movable shield 50 and absorbing an impact caused by the hinge motion of the movable shield 50.

Thus, the head lamp in a vehicle in accordance with various embodiments of the present invention can increase utilization efficiency of the light emitted from the light emitting portion 82 by utilizing the light shielded by the movable shield 50. And, the enlarged high beam directing area enables to improve and secure vehicle running safety owing to movement of the movable shield 50.

For convenience in explanation and accurate definition in the appended claims, the terms "upper" or "lower", "front" or "rear", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A head lamp in a vehicle comprising:

a light source for emitting a light;

a reflector for reflecting the light forward from the light source;

a lens for transmitting the light being forwarded toward a front from the light source and the reflector;

a holder having one end coupled to the lens and the other end coupled to the reflector to make the lens spaced at a predetermined distance from the reflector; and a movable shield disposed between the light source and the reflector and the lens for selectively shielding a portion of the light being forwarded toward the lens from the light source and the reflector, or not shielding the portion of the light being forwarded toward the lens from the light source and the reflector when being moved to create a space between the movable shield and a lower end of the holder to allow the light pass through, wherein the movable shield shields the portion of the light being forwarded toward the lens with a first side of the movable shield, and wherein the light emitted between the movable shield and the lower end of the holder from the light source when the movable shield is moved is configured to be reflected at a second side of the movable shield and directed to the front of the head lamp through the space formed between the movable shield and the lower end of the holder.

2. The head lamp in a vehicle of claim 1, wherein the light reflected at the second side of the movable shield and directed to the front produces a high beam.

3. The head lamp in a vehicle of claim 1, wherein the movable shield is hinge coupled to the holder and movable by a hinge motion.

4. The head lamp in a vehicle of claim 3, further comprising:

a solenoid connected to the movable shield for moving the movable shield upon having power supplied thereto.

5. The head lamp in a vehicle of claim 1, further comprising:

a fixed shield provided between the movable shield and the lens and having a first side for shielding the portion of the light being forwarded toward the lens from the light source and the reflector and a second side for absorbing lights reflected and scattered by an inside surface of the holder and by an inside surface of the lens.

6. The head lamp in a vehicle of claim 5, wherein the movable shield is hinge coupled to the fixed shield and movable by a hinge motion.

7. The head lamp in a vehicle of claim 6, further comprising:

a solenoid coupled to the fixed shield connected to the movable shield for moving the movable shield upon having power supplied thereto.

8. The head lamp in a vehicle of claim 7, further comprising:

an elastic member provided to a portion at which the movable shield and the fixed shield are hinge coupled for returning the movable shield to an original position if power supply to the solenoid is cut off.

9. The head lamp in a vehicle of claim 7, wherein the reflector has a stopper formed thereon for being brought into contact with the moving movable shield for preventing the hinge motion of the movable shield from progressing excessively by the solenoid.

10. The head lamp in a vehicle of claim 9, wherein the stopper is formed to prevent impact of contact with the movable shield.

11. The head lamp in a vehicle of claim 8, further comprising:

a buffer portion formed at a portion the fixed shield is to be brought into contact with the movable shield for preventing an impact of contact with the fixed shield when the movable shield returns to the original position by the hinge motion owing to the elastic member.

* * * * *